US006371645B1

(12) United States Patent
Rusert et al.

(10) Patent No.: US 6,371,645 B1
(45) **Date of Patent: *Apr. 16, 2002**

(54) OPEN MESH BAG

(75) Inventors: Craig R. Rusert, Dunwoody; Paul N. Antonacci, Atlanta, both of GA (US)

(73) Assignee: Amoco Nisseki Claf, Inc., Atlanta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/158,307

(22) Filed: Sep. 22, 1998

Related U.S. Application Data

(60) Provisional application No. 60/059,720, filed on Sep. 22, 1997.

(51) Int. Cl.[7] ..... B65D 33/22
(52) U.S. Cl. ..... 383/107; 383/117
(58) Field of Search ..... 383/117, 107

(56) References Cited

U.S. PATENT DOCUMENTS

| | | | | | |
|---|---|---|---|---|---|
| 2,416,747 | A | * | 3/1947 | Geimer | 383/117 |
| 2,565,754 | A | * | 8/1951 | Brady et al. | 383/76 X |
| 3,279,511 | A | * | 10/1966 | Griffin, Jr. | 383/107 X |
| 3,470,928 | A | * | 10/1969 | Schwartz | 383/107 X |
| 4,010,785 | A | * | 3/1977 | Patik | 383/117 X |
| 4,801,081 | A | * | 1/1989 | O'Connor | 383/117 X |
| 5,730,530 | A | * | 3/1998 | Stoddard et al. | 383/117 X |
| 5,823,683 | A | * | 10/1998 | Antonacci et al. | 383/117 X |

FOREIGN PATENT DOCUMENTS

| | | | | |
|---|---|---|---|---|
| DE | 2636821 | * | 2/1978 | 383/117 |
| JP | 45359 | * | 2/1990 | 383/117 |
| NL | 38062 | * | 5/1936 | 383/117 |

* cited by examiner

*Primary Examiner*—Jes F. Pascua
(74) *Attorney, Agent, or Firm*—Joel D. Meyers; Myers & Associates,P.C.

(57) ABSTRACT

The present invention provides an improved open mesh bag comprising an open, mesh-like fabric. The bag has a closed end formed by a fold in the fabric, an opposing end and longitudinal, heat-sealed side seams extending from the closed end to the opposing end. The bags are used for packaging articles for which visibility and/or breathability of the bag fabric are useful characteristics. In a preferred embodiment, the bags are also suited for manufacture and filling using high speed, automated equipment.

12 Claims, 8 Drawing Sheets

OPEN MESH BAG

This application claims the benefit of U.S. Provisional Application No. 60/059,720 filed Sep. 22, 1997.

FIELD OF THE INVENTION

This invention relates to open mesh bags suitable for packaging goods and articles.

BACKGROUND OF THE INVENTION

Heretofore, open mesh bags have been used for various packaging applications including those in which breathability and visibility of the bags' contents are important features. Examples include produce bags for fruits, vegetables and other agricultural products and bags for sporting equipment, toys, blocks and various other small to medium size solid objects. Such bags have been made from solid plastic films, tubular packaging materials, such as VEXAR originated by E.I. du Pont de Nemours and Company, leno weave fabrics, knitted fabrics and flat woven fabrics. Each of these has disadvantages. For example, tubular materials require investment in specialty equipment to prepare bags from same (see, e.g., U.S. Pat. No. 4,091,595). Flat weave and knitted packaging materials, while avoiding complexities associated with tubular goods, are disadvantageous because they are typically sewn to form seams. This adds cost. Nonwoven fabrics seldom achieve a practical balance of strength and contents-visibility and they are often difficult to seam with appropriate strength. Plastic films lack breathability; attempts to overcome this limitation, such as by perforation, add cost, can impair strength and generally do not perform satisfactorily.

Beyond traditional attributes of produce bags, including strength, breathability and sufficient transparency or openness to allow viewing of their contents, high speed and automated bagmaking and filling equipment have imposed additional requirements. To process well on high speed bagmaking equipment, bag substrates must track precisely through the equipment and remain in registration over the entire sequence of bagmaking steps. The substrate must remain precisely in registration through repeated accelerations and decelerations so that each step of the bagmaking operation, e.g., seaming, label application, die cutting, finished bag cut-off, is performed in precisely the right position on the bag. Dimensional stability of a bag substrate is important for such operations from the standpoint of maintaining registration and avoiding deformation as the material rapidly starts and stops during its progression through the bagmaking equipment.

The substrate must also be a material that can be seamed with adequate strength to withstand filling operations, transportation and handling. Bags manufactured from open-mesh fabrics can be problematic in this respect, particularly those that comprise a delicate, net-like material and/or have only limited surface area available for seaming. Limited area for contact between opposite layers of the fabric tends to make heat sealed seams weak, if effective at all. Seaming with adhesives tends to be aesthetically unattractive. Sewn seams add cost and are often ineffective due to the small surface area of the open mesh fabric.

U.S. Pat. No. 3,123,279 discloses a plastic open-mesh bag having a thermoplastic film joined to a thermoplastic net along three margins of the film made by folding the film over the net and sealing the film through the net.

There remains a need for improved open mesh bags, and particularly bags that have the traditional attributes of conventional open mesh bags, such as breathability and contents-visibility, and also meet the criteria for high speed bagmaking machines.

SUMMARY OF THE INVENTION

Briefly, this invention provides a bag comprising an open mesh fabric and having a closed, butt end, an opposing end, and at least two longitudinal seams extending from the butt end to the opposing end, wherein the butt end is formed by a fold in the fabric on a central axis and each seam comprises a section of fabric from each side of the fold to which is heat sealed a thermoplastic sealing strip. The thermoplastic sealing strip to which the fabric is sealed comprises a thermoplastic resin or blend of resins having a melting temperature or heat seal temperature lower than the melting temperature of the fabric. Optionally, a label, print band or other decorative elements can be affixed to the bag.

Importantly, the inventive open mesh bags can be manufactured with ease on industrial high speed automated bagmaking equipment. Heat-sealable film strips comprising a thermoplastic resin are preferably applied by lightly heat sealing the strips across approximately one half the width of the fabric, preferably in the cross machine direction, so that when the fabric is folded on a central axis the film strip extends perpendicular to the fold and along the full height or length of the bag. In addition, the invented bags are well suited for use in automated bag filling operations owing to their dimensional stability and ability to be wicketed. Significantly, these attributes are achieved without loss of other important features, including strength, flexibility, breathability and contents-visibility.

BRIEF DESCRIPTION OF THE DRAWINGS

There are described hereinafter in detail nonlimiting embodiments of the invention with reference to the accompanying drawing in which.

DETAILED DESCRIPTION OF THE INVENTION

Figure 1:
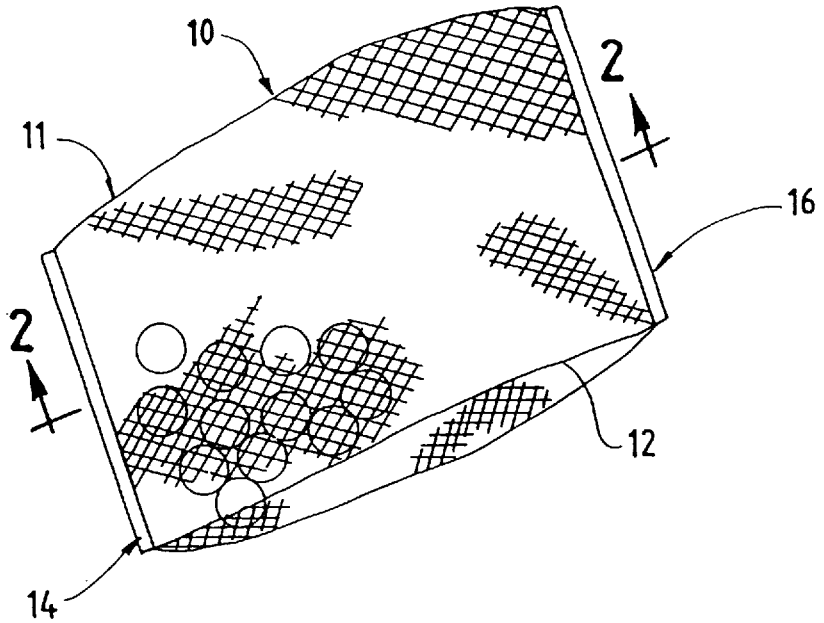
FIG. 1 is a perspective view of an open mesh bag according to the invention.
Figure 11:
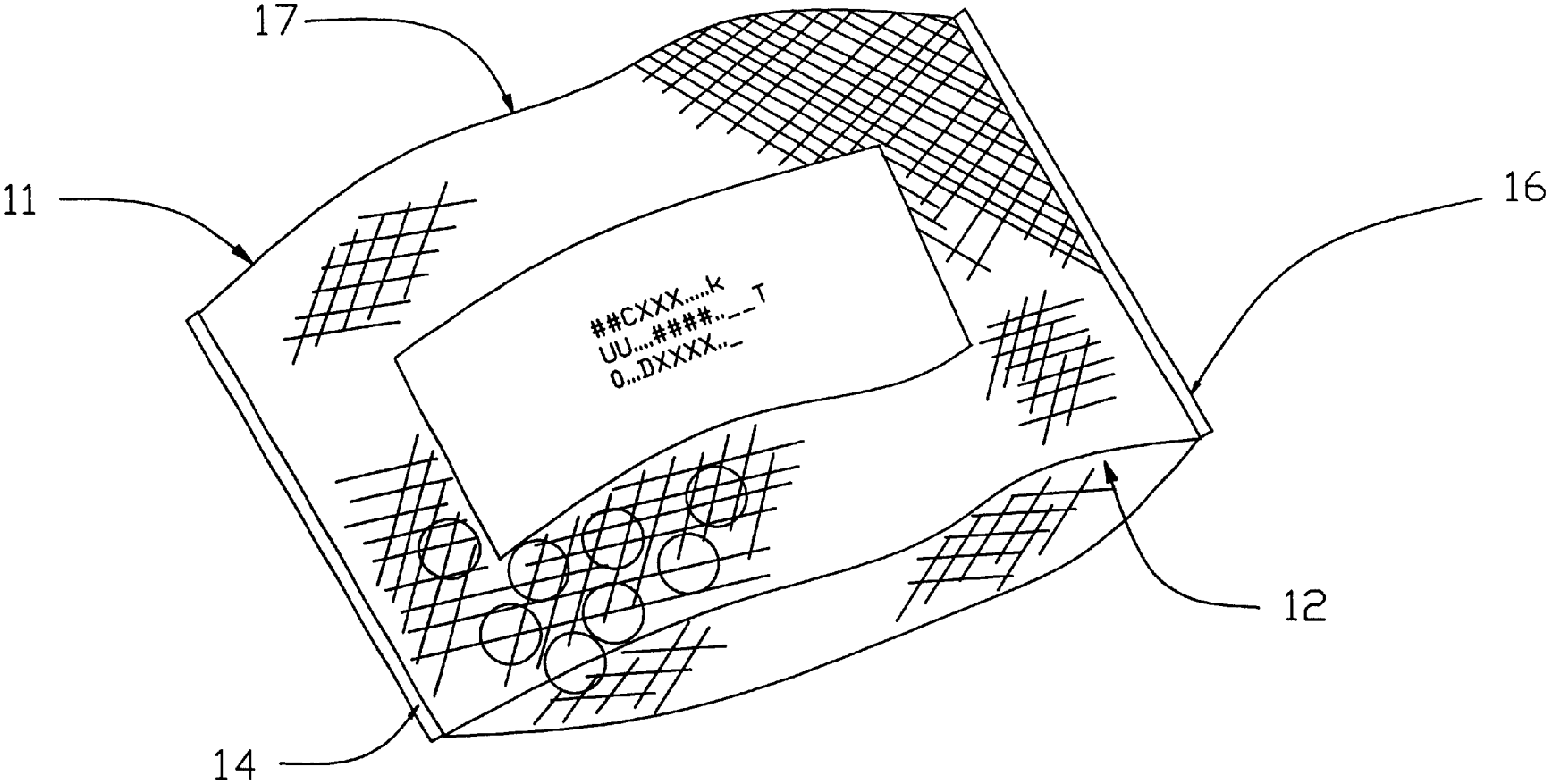
FIG. 11 is a perspective view of an open mesh bag as in FIG. 1 with a label affixed to the fabric.

The open mesh bag of the present invention is formed from an open mesh fabric. Referring to FIG. 1, an open mesh bag 10 is shown. Bag 10 is constructed of an open, mesh-like fabric and has a bottom, or butt end, 12 formed by a fold in the fabric on a central axis between side seams 14 and 16. The fabric on each side of the fold extends from the fold and terminates at opposing end 11 of the bag. The opposing end can be open, for example prior to filling thereof, or it can be closed, for example after filling of the bag. Any suitable means for effecting such closure can be used, such as stitching or sewing, lacing and tying, stapling, use of adhesives, heat sealing and use of zip-lock or twist-type closures. Referring again to FIG. 1, side seams 14 and 16 of bag 10 are heat-sealed. The butt and opposing ends of the bag, together with the heat sealed seams, define a perimeter of the fabric that forms a space or volume for receiving and containing contents of the bag. One having the benefit of this disclosure will appreciate that a label or band can be affixed to the open mesh bag, for example by heat sealing, with adhesives of by stitching. The label or band may be preprinted or it may be of a material suitable for subsequent printing. FIG. 11 illustrates a bag 17 with a label 19 attached to the open mesh fabric.

Figure 2:
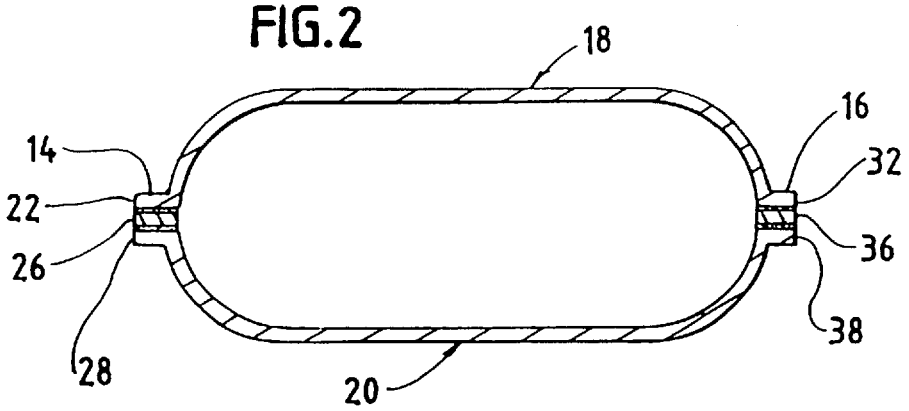
FIG. 2 is a cross-sectional view of the open mesh bag of FIG. 1.

In greater detail, FIG. 2 further illustrates the construction of the bag of FIG. 1. In particular, front 18 and back 20 of bag 10 with side seams 14 and 16 are shown. Also seen are edges 22 and 32 of front 18 and edges 28 and 38 of back 20. Strips 26 and 36 are sealed to the fabric at the edges to form longitudinal seams. Side seam 14 is shown with edge 22 of front 18 having strip 26 heat sealed thereto. Strip 26 also is heat sealed to edge 28 of back 20 of bag 10. In a like manner, side seam 16 is shown with edge 32 of front 18 having a heat seal between edge 32 and strip 36. Strip 36 also has a heat seal between strip 36 and edge 38 of back 20. By virtue of the heat sealing of the seam, the edges of the fabric that form the seam are embedded in the thermoplastic sealing strip, thereby providing strength despite low surface area of the open mesh fabric at the seam.

Heat-sealed side seams 14 and 16 can be as wide as necessary to effectively bond the fabric at the seams. Seam widths of about ¼ inch to about 1 inch are preferred, with seam widths of about ¼ inch to about ½ inch being well suited for bags of up to about 10 pounds capacity and widths of about ½ inch to about 1 inch being well suited for bags in the range of about 10 to about 20 pounds capacity. As will be appreciated by those skilled in the art having the benefit of the description provided herein, optimum seam widths will vary depending on size, construction and intended use of a bag.

While the bag illustrated in FIGS. 1 and 2 represents a preferred construction for some end uses, it will be appreciated that a wide range of modifications and alternatives to that construction are contemplated according to the invention. In one alternative embodiment, referred to as a lipped bag, the open mesh fabric at the open end of the bag is somewhat shorter on one side of the bag than the other to facilitate use of the bags in automated filling operations; this also can facilitate closing of the open end of the bag because the additional fabric from the longer side of the bag provides a convenient flap that can simply be folded over onto the shorter side and heat sealed, stitched or otherwise sealed to form an effective closure for the bag. In yet another embodiment, gussets can be incorporated into the final bag structure such as by folding during forming of the bags. In another embodiment, a plurality of bags connected top-to-bottom or side-to-side can be provided in the form of a roll, with separation of individual bags being accomplished in connection with filling or other use of the same. The bags can also be adapted for use in form-fill-seal applications.

According to another embodiment of the invention, the invented bags can be provided in the form of a stack made up of a plurality of bags disposed on a wicket. Wicketing facilitates use of bags with high speed, automated bag filling equipment. The wicket generally is in the form of a wire or rod having two right angle bends and adapted to receive and hold in place the bags by means of holes punched or otherwise made in an end of the bags, and most preferably in the longer side of a lipped bag at the open end thereof. Advantageously, the dimensional stability of the bag fabric aids in maintaining the holes in registration and also prevents fraying of the fabric due to the holes.

The open mesh bag of the present invention can be constructed, in general, from any open mesh fabric to which can be heat sealed a thermoplastic strip to form a seam. Woven, knit, scrim, extruded net and nonwoven fabrics can be used provided they have sufficient openness of construction to allow adequate visibility of a bag's contents. Preferably, the open mesh fabric also is suitable for processing into bags using high speed bag-making equipment. To that end, fabrics having a coefficient of friction according to ASTM 3334-80 Section 15 of less than about 30° and dimensional stability such that the fabric, when folded and seamed, can withstand a force of at least about one g without substantial deregistration are especially preferred. Most preferred fabrics have coefficients of friction of about 15° to about 25° and can withstand g forces of at least about 2 without substantial deregistration.

Woven and knit fabrics can be constructed and prepared in any suitable manner. From a cost and performance standpoint, so-called tapes or slit-film ribbon yarns are preferred for such fabrics. Any suitable weave or knit providing an appropriate level of openness to impart breathability of the fabric and visibility of a bag's contents can be utilized. Examples include flat and leno weave fabrics and knitted fabrics. Such fabrics also can be employed with coatings or heat sealing to provide enhanced dimensional stability and fray resistance to the same. Of course any such coating must be applied to the fabric in a discontinuous manner, that is, so that less than the entire surface of the fabric is coated, in order to ensure that the coated fabrics have adequate breathability. Various techniques for discontinuous coating of fabrics are well-known. An example is stripe coating as disclosed in U.S. Pat. No. 4,557,958. Heat sealing also can be utilized to improve dimensional stability of such fabrics, as will be appreciated by persons skilled in the art. In the case of these fabrics, whether a leno weave, flat weave, knit or otherwise, the yarns of the fabric or such yarns and any coatings will generally comprise a thermoplastic resin composition. It also is contemplated to form the fabric or coated fabric from thermoplastic resin compositions having different melting points, with a higher melting resin being present to provide strength and integrity to the fabric and a lower melting resin being present, either as a discontinuous coating on the surface of the fabric or laminated to or as part of the yarns thereof, e.g., as coextruded tapes, to provide for heat bonding of the yarns of the fabric to one another and, in turn, greater dimensional stability and resistance to fraying. Like considerations are applicable to scrims.

Nonwoven netlike fabrics, extruded nets and scrims are also suitable as open mesh fabrics for the invented bags. These materials typically have a reticulated or netlike structure, with a plurality of interconnected, intersecting fibrils or ribs defining a plurality of open spaces in the fabric. The fibrils preferably are disposed in a regular pattern, thereby forming a grid that defines the open spaces. Depending on the pattern formed by the fibrils, the open spaces may all be the same size and shape or they may be of different sizes and/or shapes. The netlike webs comprise one or more thermoplastic resin compositions or formulations. These materials can be made by various means such as thermally bonding a series of filaments laid down in a predetermined pattern, controlled slitting and/or splitting and stretching of film-forming thermoplastic resin compositions to achieve a netlike structure and others. Lamination of two or more such structures, preferably with at least two layers thereof disposed such that the machine direction of one is essentially perpendicular to the machine direction of another, can be employed to provide materials of greater strength than single layer structures.

Whether the fabric is a woven, knit or scrim material or a nonwoven, preferred thermoplastic resins therefor are polyesters and polyolefins such as polypropylene, polyethylene and copolymers of propylene and polyethylene. High, medium, low and linear low density polyethylenes are contemplated, as are so-called metallocene polyolefins. Preferred combinations of resins are polypropylene or polyethylene terephthalate for strength or load-bearing components of the fabric and polyethylene or blends thereof with polypropylene for the heat-sealable components thereof and high density polyethylene for the strength or load-bearing components and low density polyethylene for the heat-sealable components.

Most preferably, the bags are formed from a cross-laminated nonwoven fabric made from coextruded film that has been split and stretched. Such fabrics can comprise any suitable film-forming thermoplastic resin. Among the film-forming materials which can be employed in making the cross-laminated thermoplastic net-like webs are thermoplastic synthetic polymers, including polyolefins such as low density polyethylene, linear low density polyethylene, polypropylene, high density polyethylene, so-called metallocene polyethylenes, random copolymers of ethylene and propylene and combinations of these polymers; polyesters; polyamides; polyvinyl polymers such as polyvinylalcohol, polyvinylchloride, polyvinylacetate, polyvinylidenechloride and copolymers of the monomers of these polymers. Preferred materials are polyesters and polyolefins such as polypropylene, random copolymers of propylene and ethylene, and a combination of high density polyethylene and low density polyethylene. Especially preferred resins are polyethylenes and combinations thereof such as a layer of high density polyethylene and a layer of low density polyethylene.

These thermoplastic synthetic polymers may contain additives such as stabilizers, plasticizers, dyes, pigments, anti-slip agents, and foaming materials for foamed films and the like.

To form the cross-laminated, nonwoven, open mesh fabrics, thermoplastic material can be formed into a film by extrusion, coextrusion, casting, blowing or other film-forming methods. The thickness of the film can be any workable thickness with a typical thickness in the range of about 0.3 to about 20 mils. Coextruded films can be used containing two or more layers of thermoplastic material, such as a layer of polypropylene and a layer of low density polyethylene, wherein one layer provides about 5 to about 95% of the thickness of the film and the second layer provides the remaining thickness. Such coextruded structures most preferably are formed from first and second thermoplastic resin compositions wherein the first composition is a higher melting point resin component that provides strength or load-bearing capability to the fabric and the second composition is a lower melting point resin that has good adhesion to the first composition and can also provide heat sealability of the fabric to other materials.

Another type of coextruded film construction comprises a three-layer construction. Each of the three layers can be a different thermoplastic polymer. More often, however, the three-layer coextruded film is made with the same material for the exterior two layers and a different polymer for the interior layer. The interior layer can provide about 5 to about 95% of the film thickness. Preferably, the interior layer provides from about 50 to about 80% of the thickness and the outer two layers make up about 20 to about 50% of the thickness, with the outer two layers most preferably having about equal thickness. Coextruded films are typically used for making cross-laminated thermoplastic net-like webs in which one layer of film is cross-laminated and bonded to a second layer of film with the exterior layers of the films containing compatible and easily bondable thermoplastic materials such as low density polyethylene or linear low density polyethylene.

The film can be oriented by any suitable orientation process. Typical stretch ratios are about 1.5 to about 15 depending upon factors such as the thermoplastic used and the like. The temperature range for orienting the film and the speed at which the film is oriented are interrelated and dependent upon the thermoplastic used to make the film and other process parameters such as the stretch ratio, as well known to those skilled in the art.

A particularly preferred nonwoven netlike fabric for the invented bags is a so-called "cross laminated airy fabric," also known by the Nippon Petrochemical Company Ltd. trademark CLAF®. This material can be characterized as a net-like web or nonwoven and is described in detail in commonly assigned U.S. Pat. No. 5,182,162 which is incorporated herein by reference. As described in that patent, such fabrics have a net-like structure comprising a multiplicity of aligned thermoplastic fibril- or rib-like elements wherein first elements are aligned at about a 45° to about 90° angle to second elements and the elements define borders for multiple void areas of the net-like nonwoven structures. The borders which define the void areas can be parallelogram-shaped such as a square, rectangle or diamond, or ellipse-shaped such as a circle or ellipse, depending on the process of formation of the net-like web. The elements which define the borders can be in the same plane or different planes. Elements in different planes can be laminated to each other. A preferred thermoplastic net-like web is a cross-laminated thermoplastic net-like web having a uniaxially oriented thermoplastic net or web laminated to a second oriented net or web of a thermoplastic such that the angle between the direction of orientation of each film is about 45° to about 90°. The webs can have continuous or discontinuous slits to form the void areas of the net-like web and can be formed by any suitable slitting or fibrillation process. The net-like structure can also be formed by other means such as forming on one side of a thermoplastic film a plurality of parallel continuous main ribs and forming on the opposite side of the film a plurality of parallel discontinuous ribs with the film being drawn in one or two directions to open the film into a network structure, punching or stamping out material from a film to form a pattern of holes in the film and stretching the film to elongate the spaces between the holes. The net-like structure can also be formed by extrusion with the net being oriented by a stretching operation.

Cross-laminated thermoplastic net-like webs can be made by bonding two or more layers of uniaxially oriented network structures together wherein the angle between the directions of uniaxial orientation of the oriented films is between about 45° to about 90° in order to obtain good strength and tear resistance properties in more than one direction. The orientation and/or formation of the network structure in the films can be completed before the bonding operation or it can be done during the bonding process. Bonding of two or more layers of network structure films can be accomplished by applying an adhesive between the layers and passing the layers through a heating chamber and calender rolls to bond the layers together, or by passing the layers through heated calender rolls to thermally bond the layers together, or by using ultrasonic bonding, spot bonding or any other suitable bonding technique.

As described in U.S. Pat. No. 4,929,303, the cross-laminated net-like webs can be nonwoven cross-laminated fibrillated film fabrics as described in U.S. Pat. No. 4,681,781. The cross-laminated fibrillated films are disclosed as high density polyethylene (HDPE) films having outer layers of ethylene-vinyl acetate coextruded on either side of the HDPE or heat seal layers. The films are fibrillated, and the resulting filament-like elements are spread in at least two transverse directions at a strand count of about 6–10 per inch. The spread fibers are then cross-laminated by application of heat to produce a non-woven fabric of 3–5 mils thickness with about equal machine direction and transverse direction strength properties well suited for thin, open mesh fabrics of exceptional strength and durability. As disclosed in U.S. Pat. No. 4,929,303, the open mesh fabric is suitable for joining with other materials, such as papers, films, foils, foams and other materials, by lamination or extrusion coating techniques, or by sewing or heat sealing. The fabric may be of any suitable material, but is preferably low density polyethylene, linear low density polyethylene, polypropylene, blends of these polymers and polyesters. The open mesh fabrics generally have an elongation (ASTM D1682) less than about 30%; an Elmendorf tear strength (ASTM D689) of at least about 300 g; and a breakload (ASTM D1682) of at least about 15 lb/in. Reported uses of cross-laminated fibrillated film fabrics include shipping sacks for cement, fertilizer and resins, shopping, beach and tote bags, consumer and industrial packaging such as envelopes, form, fill and seal pouches, and tape backing, disposable clothing and sheeting, construction film and wraps, insulation backing, and reinforcement for reflective sheeting, tarpaulins, tent floors and geotextiles, and agricultural ground covers, insulation and shade cloth.

Cross-laminated thermoplastic net-like webs are available from Amoco-Nisseki CLAF, Inc. under the designation CLAF®, with examples of product designations including CLAF S, CLAF SS, CLAF HS and CLAF MS. Such fabrics are available in various styles and weights. The style designated MS is a preferred fabric for the invented bags. MS style CLAF® fabric has a basis weight of about 18 g/m$^2$ and a thickness of approximately 7.8 mils, as determined by ASTM D3776 and ASTM D1777, respectively. Properties of CLAF® fabrics that make them well suited materials of construction for manufacture of the invented bags using high speed, automated bagmaking equipment include coefficients of friction of about 15° to about 25° and dimensional stability sufficient to withstand acceleration of at least about 2 g without significant deregistration. As an indicator of such dimensional stability, grab tensile testing according to ASTM 5034-95 with test specimens cut at a 45° angle to the fabric machine direction can be used, with loads at 10% elongation of about 2.5 pounds characterizing the fabrics. Other typical properties of this fabric include machine direction grab tensile strength of about 35 pounds and elongation of about 15% according to ASTM 5034-95.

The thermoplastic strips to which the open mesh fabric of the invented bags are heat sealed to form longitudinal seams comprise at least one thermoplastic resin composition having a melting or softening point that is lower than that of the open mesh fabric. In the case of open mesh fabrics composed of two or more resin compositions with different melting temperatures, the strip resin preferably melts at a temperature lower than the higher melting component of the fabric. Preferably, the melting point of the strip resin is at least about 10° C. below the melting point of the fabric resin to facilitate heat sealing without melting or softening of the fabric. More preferably, the melting point differential is about 30° C. to about 60° C. The resin of the seaming strip should also provide sufficient seal strength and adhesion so that the bags hold product without breaking or failure at or adjacent to the seams during filling, handling and use. Preferably, the open mesh fabric and thermoplastic strips are composed of resins and so-configured as to provide longitudinal seams having a strength of at least about 5.0 lbs/2 inches as measured by ASTM D 5035-95. More preferably, seam strength is at least about 8 lbs/2 inches.

The choice of thermoplastic resin for the strips depends in part upon the amount of heat and pressure that can be applied thereto at the side seam of the open mesh bag without impacting the integrity of the bag. The resin for the strips will also depend on the choice of resin for the open mesh fabric. The thermoplastic resin may be a single resin or a blend of two or more compatible resins. In the case where HDPE is used as the higher melting temperature component of the mesh-like fabric, the thermoplastic film strip is preferably an ethylene alpha-olefin polymer or copolymer or blend of compatible polymers having a melting temperature below that of HDPE. The thermoplastic synthetic polymer resins may contain additives such as stabilizers, dyes, pigments, anti-slip agents, foaming agents and the like.

The invented bags are manufactured by a process comprising the steps of applying to an open mesh fabric at selected positions strips of a thermoplastic resin to which the fabric is heat sealable, folding the open mesh fabric along a central axis, wherein the axis and the strips are perpendicularly or essentially perpendicularly disposed, and heat sealing the fabric from both sides of the fold to the strips. In one embodiment, the bags are particularly suited for manufacture using high speed or automated bag-forming equipment, although other bagmaking machinery can also be utilized. The process also can comprise additional steps including applying a label to the fabric, cutting the fabric, before or after folding or heat sealing, into individual bags or appropriate sizes for individual bags, wicketing and stacking. In one embodiment, manufacture of bag stock comprising open mesh fabric with strips of heat sealable film comprising a thermoplastic resin affixed thereto, and most preferably heat sealed to the fabric along an edge of the film, is conducted in a first operation and the stock is converted into individual bags in a subsequent operation. Preferably, the bag stock is prepared in the form of roll goods to facilitate collection and handling of the bag stock and feeding the same to the ultimate bagmaking step. In another embodiment, the bag stock as described above is conveyed directly to the bagmaking operation comprising folding the bag stock and heat sealing of side seams.

In greater detail, the film strips are generally applied to the open mesh fabric. The strips can be secured to the fabric by any means effective to provide a strong enough bond between the fabric and the strips to stand up to downstream processing steps. Preferably, the strips are lightly heat sealed to the fabric using a sealing bar or other strip application equipment. Most preferably, the heat-sealable material in the form of strips of thermoplastic film are affixed to the fabric in the cross machine direction at uniformly spaced intervals and at a distance of about one-half the width of the fabric.

The film strips are preferably applied to approximately one-half the width of the fabric so that when the fabric is folded, the film strip will extend longitudinally along the full length or height of the bag. The exact length of the film strip across the width of the fabric will depend on the closing mechanism employed for closing the bag, with the length of the strip being somewhat less than half the width of the fabric if an overlap of bag fabric material is used to close the open end of the bag. In the case where the bags are gusseted with a one inch deep gusset, for example, the film strip is preferably applied at a distance about one inch more than one half the width of the fabric so that each layer in the gusset is touching the film.

The width and thickness of the film strip should be sufficient for effective heat sealing to form the side seams of the open mesh bag. In one embodiment of the process, the film strips are generally somewhat greater than twice the desired width of the seal for the side seam of the finished bags, thereby allowing bags to be slit at the side seam so as to reduce the frequency of applying the strips to the open mesh fabric in the process. For example, with a one inch wide seal bar, a 1 and ¼ inch wide film strip may be used and the seam slit to form two, one-half inch wide side seams. The slightly wider film strip is used to ensure that only fabric with heat-sealable film between layers of the fabric is exposed to the hot seal bar.

Thickness of the film can vary depending on whether the film is a single layer or a multi-layer film. For single layer films, suitable thicknesses are such as to effectively heat seal the seams. Generally, thicknesses of about 0.5 to about 10 mils are well suited for this purpose, with about 1 to about 5 mils being preferred. For multi-layer films, the thickness will vary depending on the characteristics the film is expected to provide to the heat-sealing of the seams. For example, a multi-layer film may comprise two outer layers of a lower melting temperature resin to enhance heat sealing characteristics and an inner layer of a higher melting temperature resin to strengthen the seam.

Figure 3:
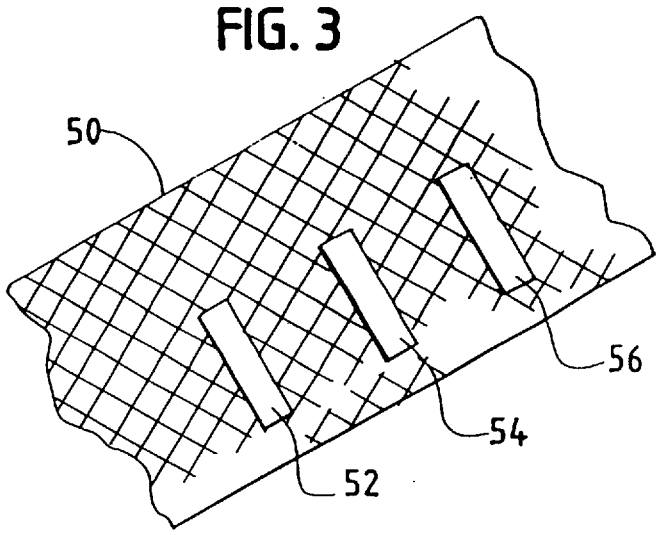
FIG. 3 is a perspective view of a section of open mesh fabric to which has been applied thermoplastic film strips for subsequent heat-sealing to form seams.
Figure 10:
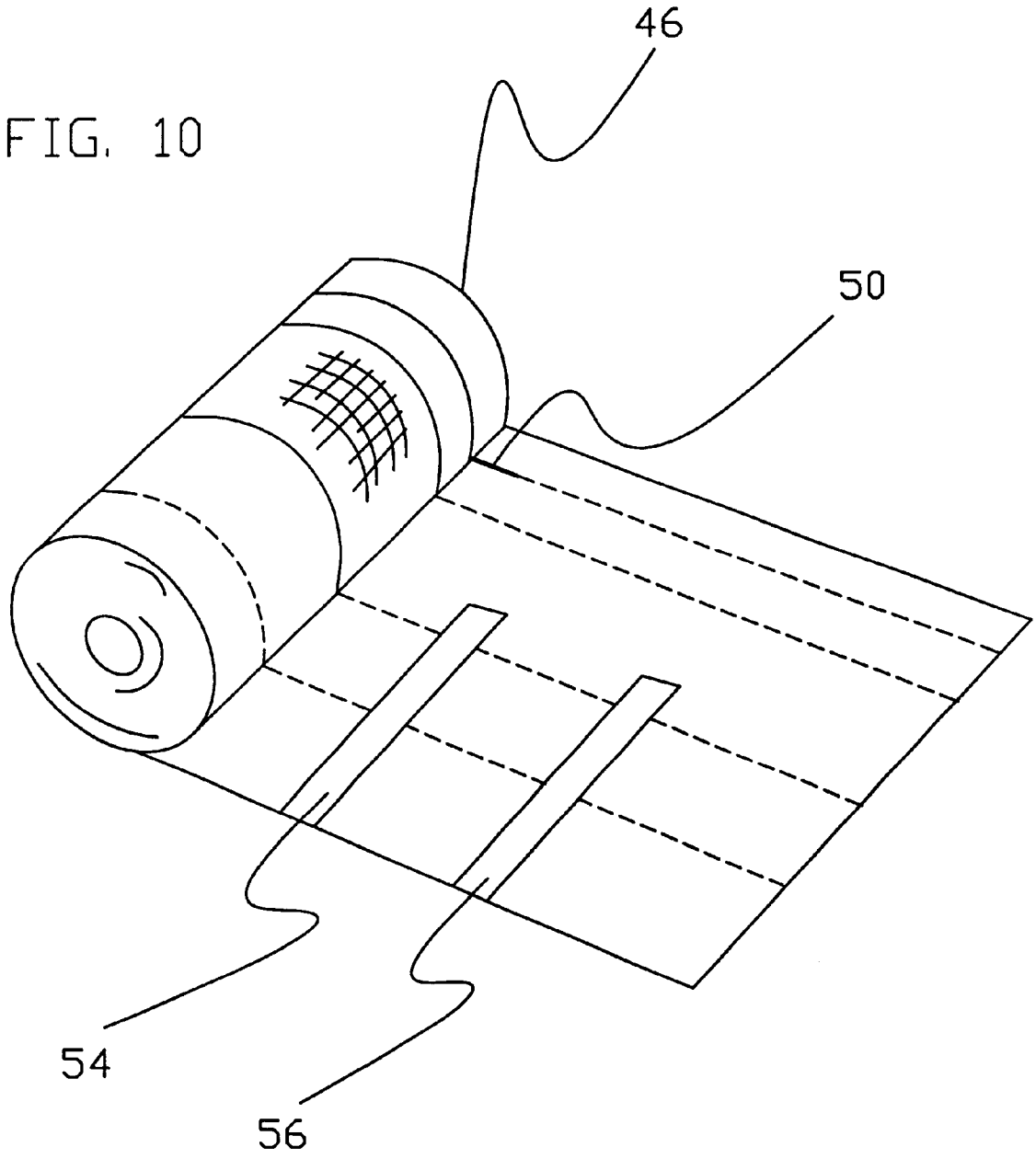
FIG. 10 is a perspective view of a roll of the bag substrate or bag stock of FIG. 3.

Referring now to FIG. 3, there is illustrated a section of an open mesh fabric with sealing strips applied thereto. Fabric in this form is suited for use as bag stock, in flat or roll form, for manufacture of bags. Thus, the present invention also provides bag stock comprising an open mesh fabric having a plurality of strips of heat sealable thermoplastic resin affixed thereto, with the strips being positioned at essentially regular intervals along a lengthwise direction of the fabric and each strip being affixed across a widthwise direction of the fabric. As seen from FIG. 3, heat sealable strips 52, 54 and 56 are secured to open mesh fabric 50 at substantially regular intervals. The strips conveniently are formed from a thermoplastic film and are lightly heat sealed or tacked to fabric 50. FIG. 10 illustrates the fabric or bag stock of FIG. 3, wherein open mesh fabric 50 with affixed strips of thermoplastic resin film, such as those designated 54 and 56, is provided in the form of roll 46. Generally, the heat-sealable film strips are about twice the desired width used in the side seams of the open mesh bags for bags formed on high speed bagmaking equipment. The bottom or butt end of the bag is formed by folding the fabric on a central axis so that each side seam of the bag comprises a section of the fabric from each side of the fold in the fabric and the heat-sealable strips are on about one-half the width of the fabric and spaced on the fabric so that the bag side seams are formed from the fabric by heat-sealing and cutting of the fabric. Each film strip 52, 54 and 56 is thus cut in half longitudinally as the bags are formed and each strip thus provides two side seams. Bag stock of the type illustrated in FIG. 3 also can be provided with a plurality of labels. Preferably the labels are each in the form of a printed or printable thermoplastic band and are affixed to the fabric along a lengthwise direction thereof. More preferably, the labels and strips are affixed to opposite surfaces of the fabric. Most preferably, when labels are present, the strips extend from a longitudinal edge of the fabric across about one-half its width on one surface thereof, the labels are positioned on the opposing surface of the fabric and the strips and labels alternate along the length of the fabric.

Heat sealing of the fabric to the heat sealable strips is conducted after the strips are properly positioned with respect to the side seams. The strips, preferably sandwiched between fabric from each side of the fold, are subjected to sufficient heat and pressure to soften or melt the strip to effect a heat-seal with the fabric. Temperatures and pressures effective to provide the heat-seal will depend in part on the particular thermoplastic strips and open mesh fabric used in making the open mesh bag as well as the thicknesses of the strips and fabric. The applied heat and pressure, of course, should not be so great as to destroy the integrity of the bag. In a preferred embodiment of the invented process, wherein a MS grade CLAF® fabric and an ethylene alpha-olefin polymer such as Affinity PF 1140 or blends thereof with polyethylenes for the heat sealable strips are utilized, temperatures of about 360° to 400° F. and pressures of about 40 to 60 psi provide an effective heat seal even at short heating times on the order of one-half second or less.

In heat sealing the heat sealable strips and the open mesh fabric to form side seams, any suitable heat seal means can be used. Examples include seal bars, heated sealing frames and the like. In general, when using a seal bar, temperatures of about 200° to about 450° F., pressures of about 30 to about 75 psi and dwell times of about 0.2 to about 2 seconds are preferred to form a seam having substantial strength when open mesh, nonwoven cross-laminated netlike fabrics such as CLAF® fabrics are used for the open mesh bag fabric.

Optionally, a print band or label can be affixed to the bag. Preferably, such labels are heat sealed to the fabric. The print band may conveniently be made from printable polymeric films available commercially such as three layer composites of, for example, a high density polyethylene/linear low density polyethylene/blend of high density polyethylene and ethylene-vinyl acetate. Such films are available, for example, from Winpak Inc., in 2 and 3 mil thicknesses. Coated films also can be used. The print band may also be made from a film comprising linear low density polyethylene/polyester or from oriented polypropylene film coated with low or linear low density polyethylene. A label made from 1.25 mil linear low density polyethylene and 0.5 mil polyester has been found to have acceptable performance properties in this application. Depending on economics, a film of linear low density polyethylene only can also be used, although the printability of such film is not as good as that of some of the composite films.

A preferred apparatus for manufacture of bag stock for making the invented bags, comprising sealing strips of a thermoplastic resin affixed to one surface of an open mesh fabric at selected locations, and optionally a printed or printable label secured to the same or an opposing surface of the fabric, comprises, in combination, means for advancing each of a bag substrate, thermoplastic polymeric film and print band from sources thereof continuously through the apparatus such that the film is brought into contact with one side of the substrate and the print band is brought into contact with the same or an opposing side of the substrate; means for intermittently stopping and resuming passage of the substrate, film and print band through the apparatus based on indicators detectible from the print band; a strip applicator disposed in the path of the substrate and the film comprising means for transversely affixing a leading edge of the film to the substrate and means for transversely cutting the film at a selected distance upstream of the leading edge thereof; a heat sealing device located in the path of the substrate and the print band downstream of the point at which the substrate contacts the print band for longitudinally heat sealing the print band to the substrate; and takeoff means for continuously removing bag stock from the apparatus. Preferably the print band is advanced through the apparatus from a double width roll of print band material by means of a braked unwind shaft, with a cutting blade or other suitable slitting device positioned in the path of the print band for cutting it into two bands, each of which is advanced through adjustable position dual turn bars onto the substrate at equal distances from the centerline thereof. A preferred strip applicator device includes means for directing bursts of air or other suitable fluid at the film from one or both sides of the substrate to assist in positioning the film relative to the substrate. Cutting of the film is preferably accomplished using a reciprocating knife blade-blade clamp assembly adapted to intermittently close on the film to cut it and open to allow advancement of film. Most preferably, the knife blade assembly includes means for heating the blade for smoother cutting. Simultaneously with cutting of the film, a leading edge of the film is affixed to the substrate, most preferably using a heat seal bar located such that it contacts the film in contact with the substrate.

Figure 4:
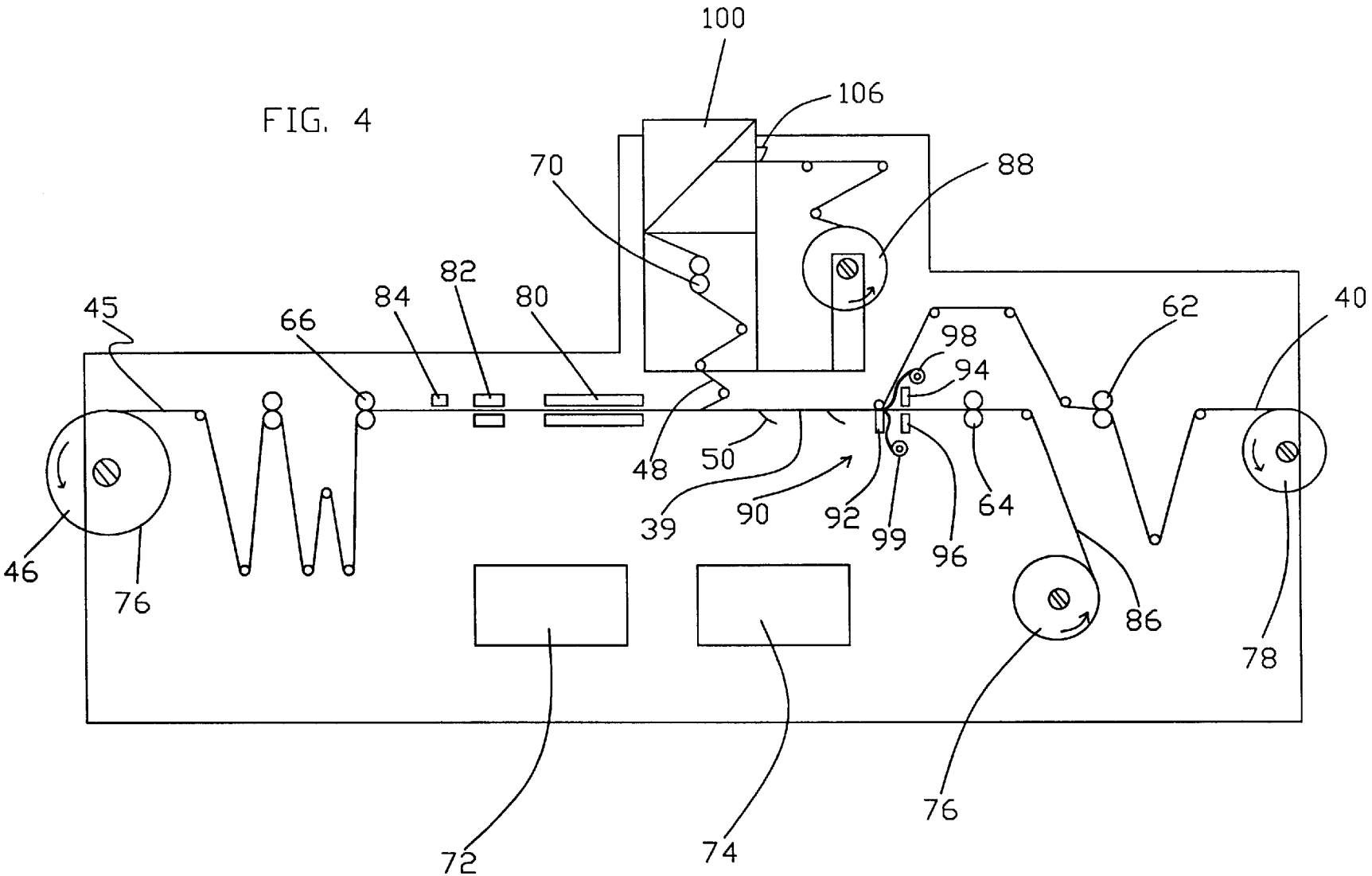
FIG. 4 is a schematic view of an apparatus for producing bag stock for making bags according to the invention.

FIGS. 4–8 illustrate a preferred apparatus and method of using the same for manufacture of bag stock from which the invented bags can be formed. Referring to FIG. 4, a roll 78 of continuous open mesh fabric 40 is unwound by web drive 62 in a continuous manner. Polymer film 86 in continuous roll form is supplied from roll 76. A predetermined length of film 86 is advanced by servo draw rolls 64. The advancement of open mesh fabric 40 is intermittently interrupted to render the fabric stationary during formation and application of polymer film strip 50 using a strip applicator assembly. Thus, a leading edge of film 86 is tacked, or lightly heat sealed, to the fabric by tack sealer 92 while the film is simultaneously cut at a predetermined position, corresponding to the width of the affixed sealing strip, by engaging upper knife clamp 94 with knife assembly 96 to sever the film. The resulting intermediate bag stock 39, comprising fabric with affixed sealing strips, advances through the apparatus for subsequent application of print bands 48. The print bands are supplied by print band system 100 and are heat sealed to the intermediate bag stock 39. Each print band is formed by splitting double width roll 88 of print band material into two equal width bands 48 using slitter 106. Print band system 100 is described in more detail below with reference to FIGS. 5 and 6.

Advancement of materials through the apparatus with intermittent stoppage at the strip applicator and the heat sealing device and resumption after they perform their respective operations on each section or portion of the materials that advance to and through them is affected by machine control system 72. It utilizes a user-friendly touch screen operator interface, digital selection of converting set up parameters, individual job parameter storage and retrieval, with print off of screens for off-line job data storage and diagnostic capabilities. Servo tool drive system 74 in conjunction with machine control system 72 and registration system 84 utilize servo draw rolls 64 and 66 to halt advancement of the intermediate open mesh fabric 39 between servo draw rolls 64 and 66 to allow the cutting and attachment of polymer film strips 50 and heat sealing of print bands 48 to the intermediate open mesh stock 39 while at the same time permitting continuous unwinding of roll 78 and continuous winding of roll 79. Registration system 84 employs a photoelectric cell to detect registration marks on the print bands 48 in order to move intermediate stock 39 the required predetermined distance for attaching the leading edge of polymer film 86 to the intermediate stock 39 and cutting off the polymer film 86 at the predetermined length to form the polymer film strip 50. At the same time and at a separate station, polymer film strip 50 is heat sealed with heat sealer 82.

Figure 5:
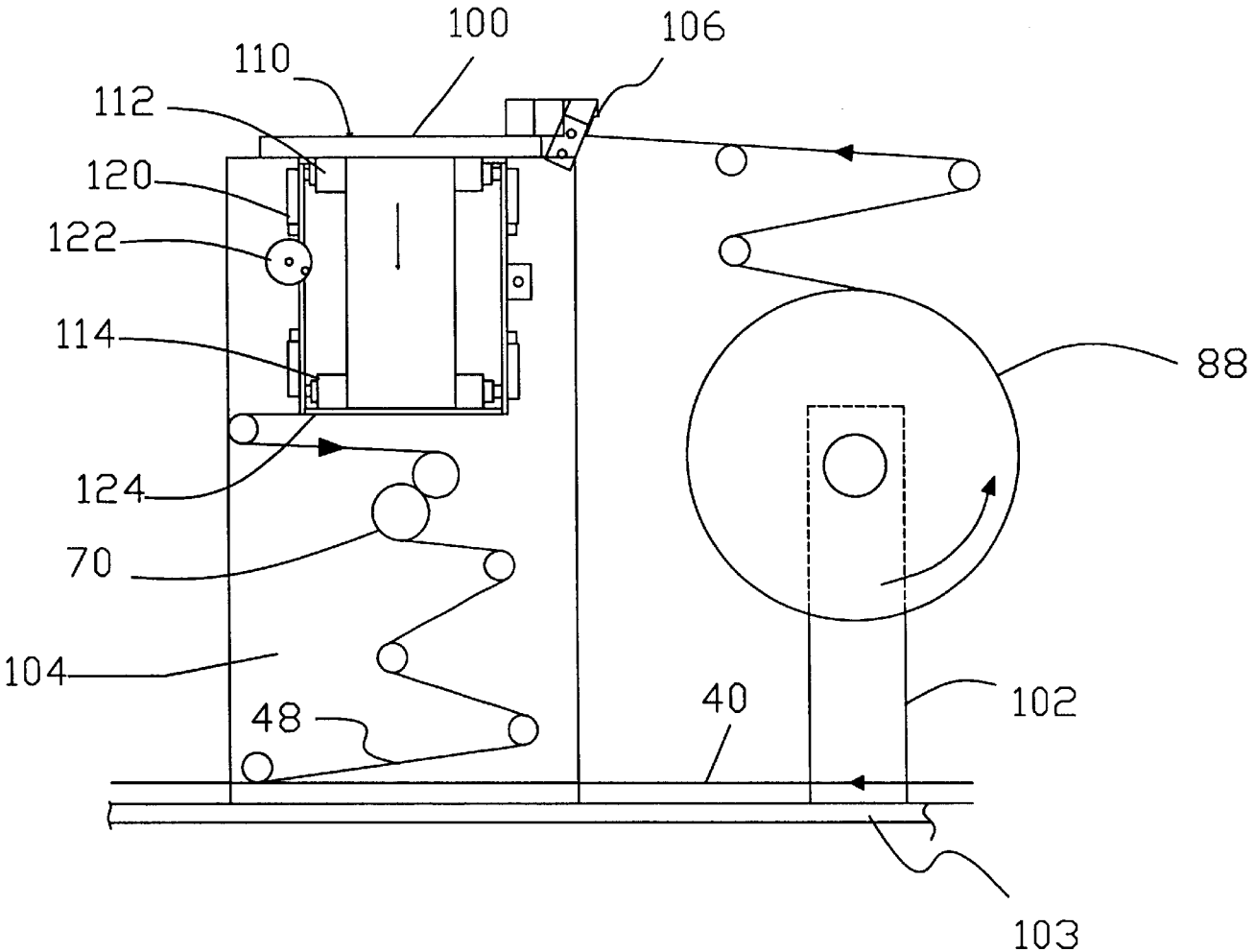
FIG. 5 is a side view of the print band system of the apparatus depicted in FIG. 4.
Figure 6:
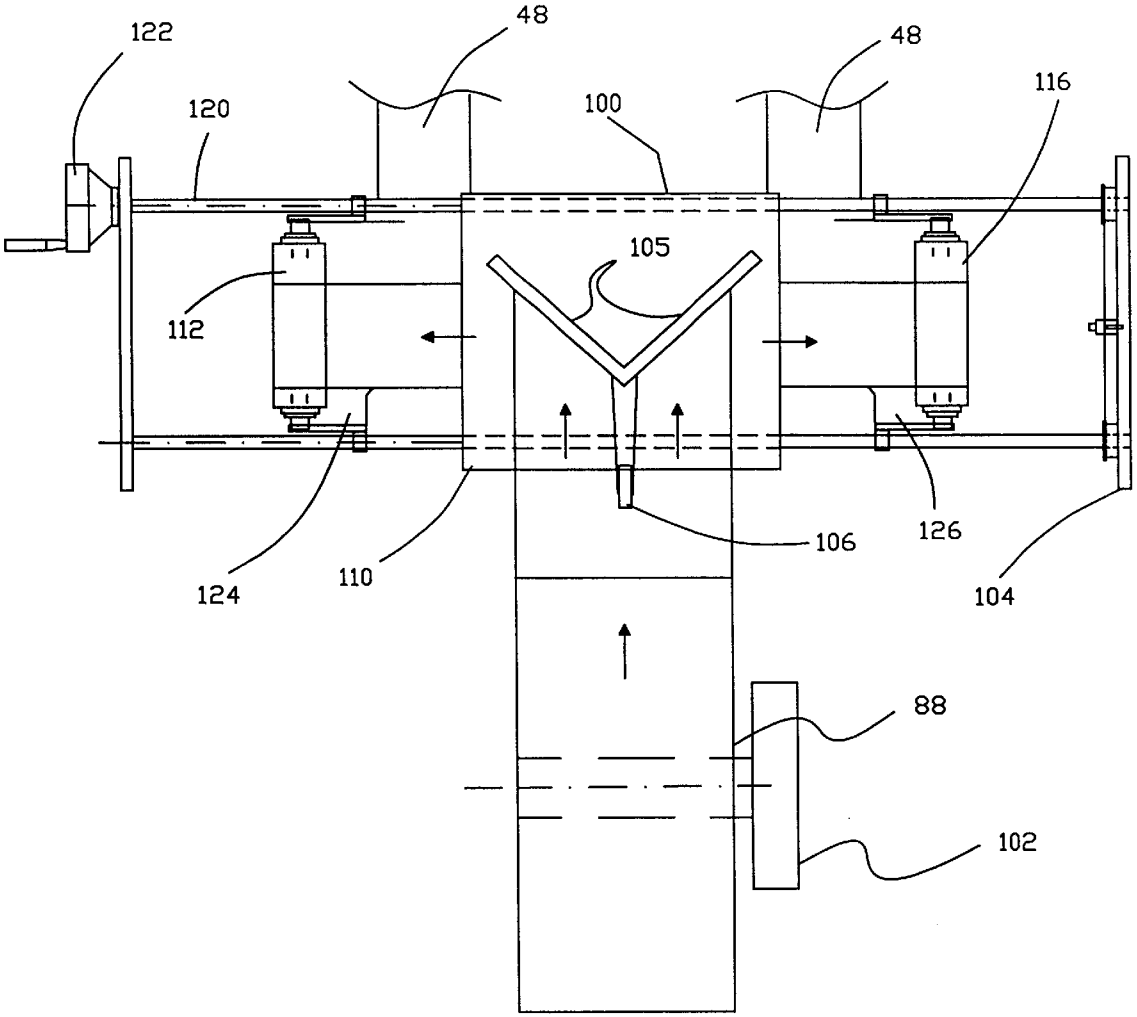
FIG. 6 is a top view of the print band system of the apparatus depicted in FIG. 4.

FIGS. 5 and 6 illustrate print band system 100. As best seen from FIG. 5, the system includes a support 104 and print band roll support 102 attached to support base 103. A double width roll 88 of print band material is slit by slitter 106 to form two continuous print bands 48. After the double width print band from roll 88 is slit, each single print band 48 is pulled through slot 105 (seen in FIG. 6) in v-shaped turning plate 110 thereby assisting in turning each of the individual bands 48 ninety degrees to the direction of advancement through the machine. The left print band 48 is fed outward to left upper turning roll 112, the print band 48 is then turned downward to left lower turning roll 114 and then turned inward and ninety degrees on left lower turning plate 124 so that the band runs parallel to the direction of advancement through the machine. Print band 48 is drawn toward open mesh fabric 40 with rolls 70. In like manner, the right print band 48 is fed outward to right upper turning roll 116, turned inward and ninety degrees on right lower turning plate 126 and drawn toward open mesh fabric 40 with rolls 70.

Figure 7:
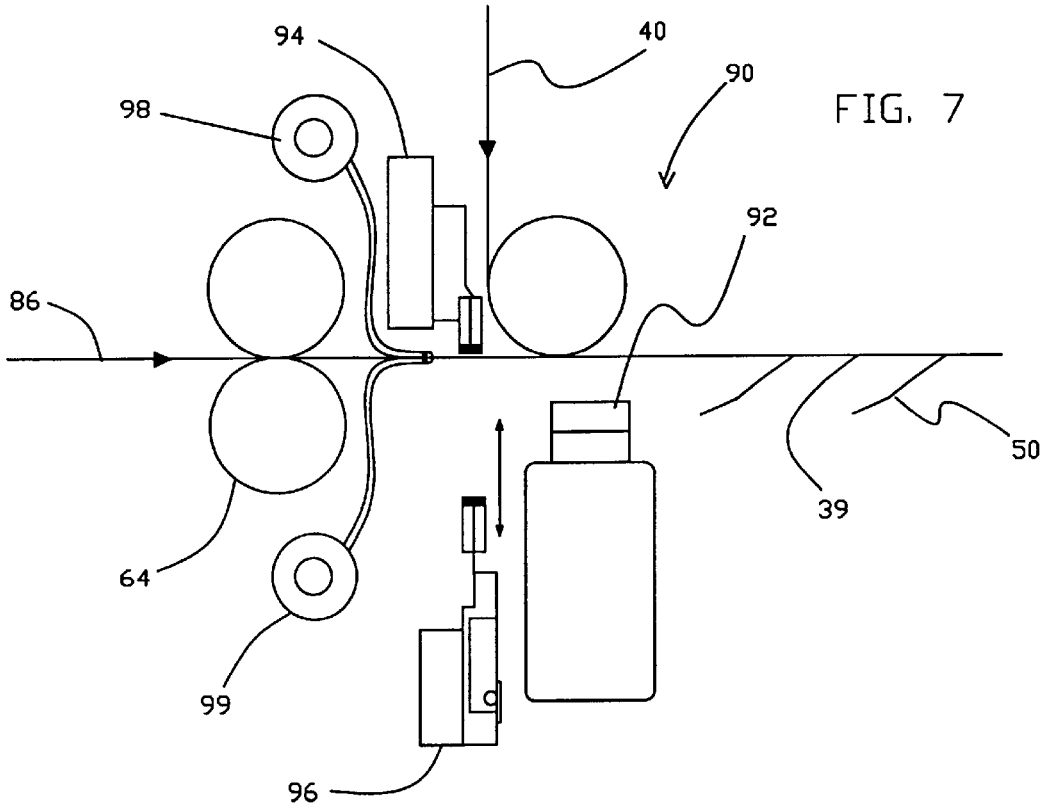
FIG. 7 is a schematic view of the strip applicator system, in feed position, of the apparatus depicted in FIG. 4.
Figure 8:
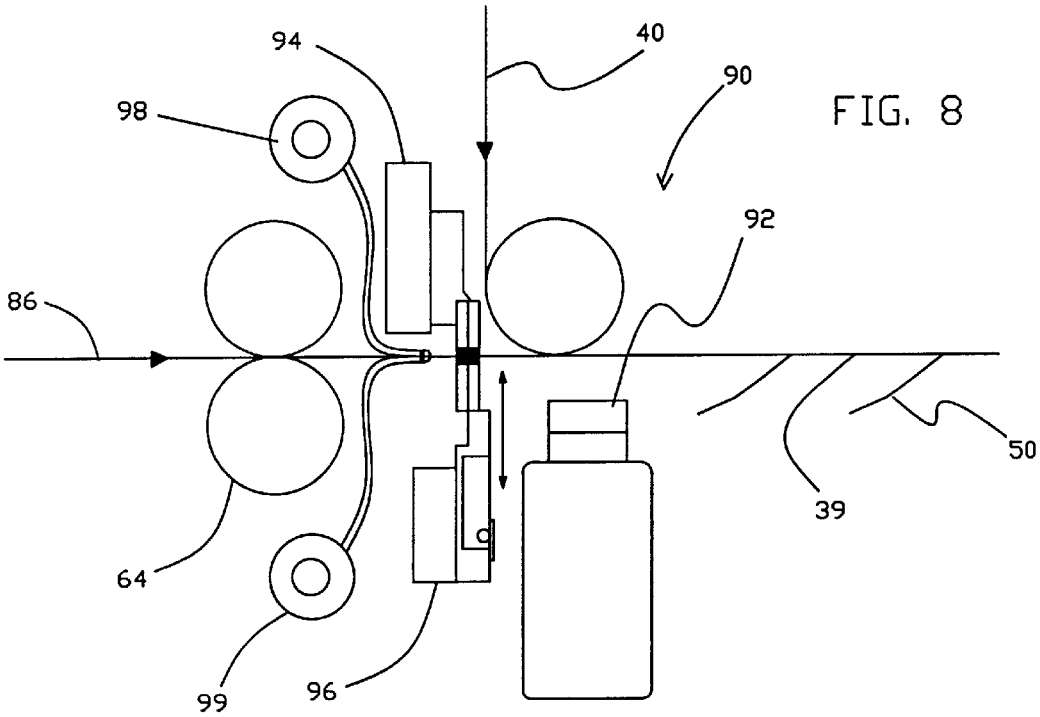
FIG. 8 is a schematic view of the strip applicator system, in the cutoff and strip application position, of the apparatus depicted in FIG. 4.

FIGS. 7 and 8 illustrate the strip applicator 90 that functions to produce a continuous intermediate bag stock 39 by cutting a polymer film strip 50 and securing it to open mesh fabric 40. The continuous polymer film 86 is supplied from the polymer film roll (not shown in FIGS. 7 and 8 but represented by reference character 76 in FIG. 4) and a predetermined length of polymer film is fed forward by polymer film strip draw rolls 64. Bursts of air are emitted from upper air stripper 98 and lower air stripper 99 to position the polymer film 86 in proper position relative to fabric 40. Referring to FIG. 8, strip tack sealer 92 is shown in the position to seal the leading edge of polymer film 86 to fabric 40. At the same time, knife assembly 96 is raised to engage upper knife clamp 94 and thereby sever film 86. The knife assembly and/or the tack sealer are movable in the direction of advancement of the fabric and film through the machine so that they can be set to a preselected distance therebetween that corresponds to the length of film to be cut and sealed to the fabric and, ultimately, heat sealed to form a side seam in the bagmaking operation. Referring to the bag stock illustrated in FIGS. 3 and 10, the distance between the knife assembly and tack sealer, and in turn the length of the cut film, correspond to the width—that is, the shorter dimension—of strips 52, 54 and 56.

Figure 9:
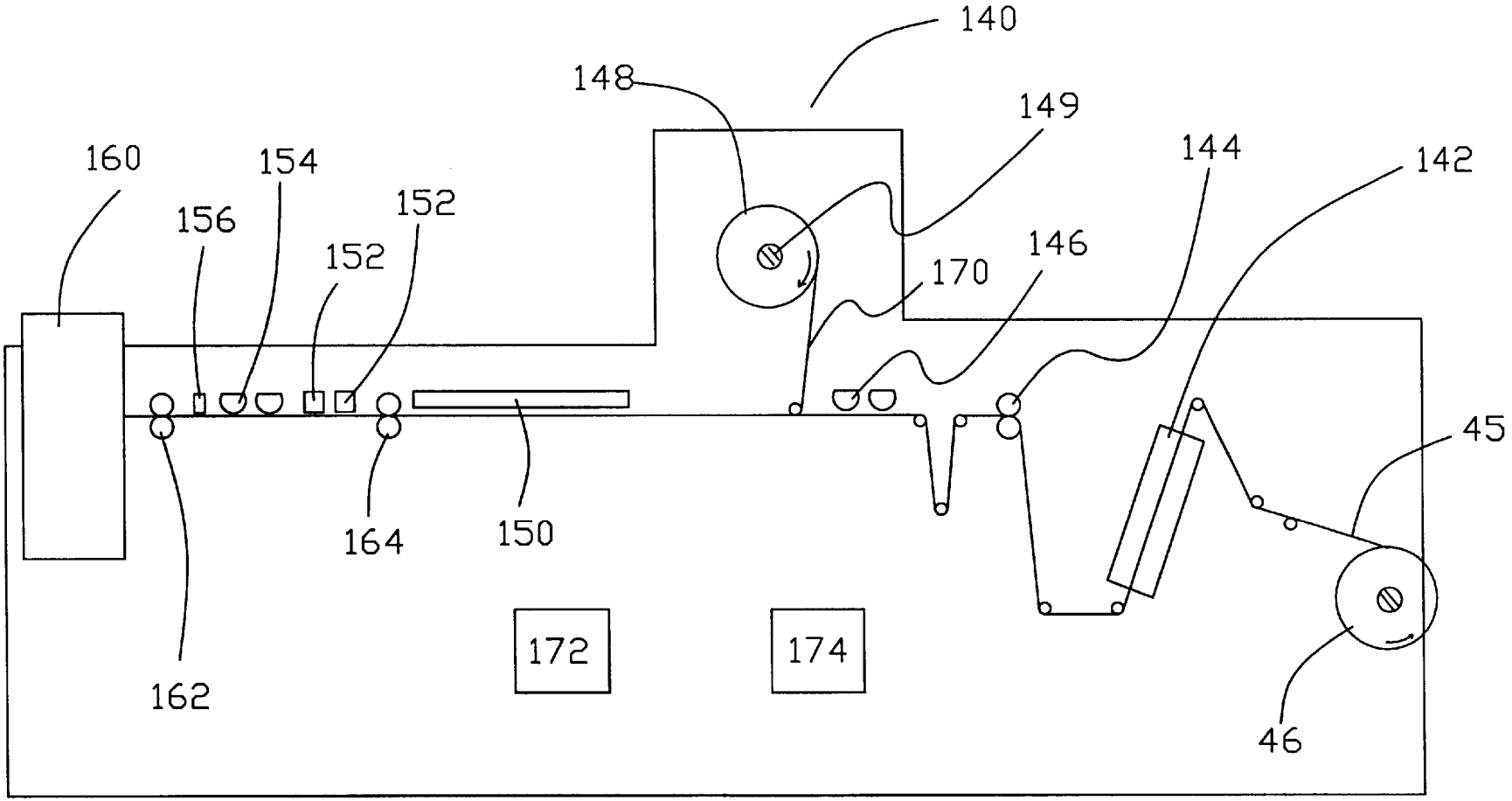
FIG. 9 is a schematic view of an apparatus for converting bag stock into open mesh bags.

FIG. 9 illustrates a preferred machine 140 for producing open mesh bags from bag stock such as that made as described above. A roll 46 of bag stock 45 with heat sealable film strips is unwound by drive rolls 144 in a continuous manner. Drive rolls 144 draw stock 45 through a folder 142 to fold the stock to a predetermined width. Typically that width is about one half the width of the fabric. For example, for flat top bags the widths of fabric extending from the fold on either side thereof are the same. For other bags, for example those having polymer strips added to provide support for wicketing and/or an area for attachment to filling machines to aid in opening the bags and/or for bags which have a wicket top without polymer film strip reinforcement, the fabric is wider on one side of the fold than on the other. The wider side of the fabric bears the polymer strip for the wicketed top and the narrower side bears the polymer film strip used by produce filling machines to open the formed bag. Optionally, folder 142 can also have a bottom gusset forming attachment.

For bags that are to be punched with wicket holes in the fabric itself, as opposed to in a polymer film strip attached to the fabric, the folded bag stock exiting folder 142 passes between drive rolls 144 to wicket punch 146 which punches holes in the wider side of fabric extending from the fold. For bags in which wicket holes are to be punched in polymer film attached to the fabric, polymer film is supplied to the folded bag stock from film roll 148 which is driven by film roll unwinder 149. Polymer film 170 can be slit in the machine or longitudinal direction into two film strips with a slitter (not shown). The film or strips are attached to the top edges of the folded stock 45 with strip sealer 150. Advancement of the folded bag stock is intermittently interrupted for attachment of the polymer strips to the top edges of the stock 45 with strip sealer 150. Simultaneously with heat sealing of the strips to the folded stock, servo draw roll 162 stops the forward movement of the folded stock, cross seams are heat sealed by cross seam sealers 152 and the polymer strip attached to the wider side of the fabric in the previous cycle has a wicket hole formed by wicket punch 154. Machine control system 172 utilizes a user-friendly touch screen operator interface, digital selection of converting set up parameters, individual job parameter storage and retrieval, with print off of screens for off-line job data storage and diagnostic capabilities. Servo tool drive system 174 in conjunction with machine control system 172 and registration system 156 utilize servo draw rolls 162 and 144 to halt advancement of the material between servo draw rolls 162 and 144 to allow the attachment of polymer strips and heat sealing of cross seams by sealer 152. Registration system 156 employs a photoelectric cell to detect registration marks on the print bands 48 to regulate the distance for moving the folded stock for heat sealing the cross seams with cross-seam sealer 152.

The product of machine 140 is collected using product collection system 160. The product can be collected as a continuous roll without forming individual bags using a windup roll as the collection system. The resulting continuous roll can be cut to form individual bags in a subsequent operation. In another embodiment, individual heat-sealed side seam bags, with either a flat top or wicketed top, are formed on the apparatus. In this embodiment, a draw roll and bag cut-off mechanism are provided including a servo driven draw roll, air assist bag delivery nozzles, static eliminator and a guillotine-style bag cut-off knife. The individual bags are stacked and collected in product collection system 160. If individual heat-sealed side seam bags with a wicketed top are to be formed, an automatic wicket top stacking conveyor, which includes servo driven pickup arms, four-station exposed wicket stacking conveyor and pin designed for wicket wire removal, can be provided. In this embodiment bags are provided in the form of a stack made up of a plurality of bags disposed on a wicket. As described above, the wicket generally is in the form of a wire or rod having two right angle bends and adapted to receive and hold in place the bags by means of holes in an end of the bags.

The invented bags are well suited as produce bags for packaging, transportation, storage and display of agricultural products such as potatoes, onions, apples, oranges, etc. They also can be used for toys, games, blocks, sporting goods and other solid articles as well as canned and bottled liquid and semi-solid products, e.g., multi-count packs of canned foods, bottled beverages and the like.

The following examples illustrate the invention but are not intended to limit its scope.

COMPARATIVE EXAMPLE

A series of open mesh fabric bags was made from a cross-laminated thermoplastic net-like web fabric available from Amoco-Nisseki CLAF, Inc. under the designation CLAF® with the fabric folded so that the fold extended in the machine direction (MD) of the fabric. The side seams of the bags were heat-sealed, without any heat-sealable material between fabric layers, using a heat sealer from Custom Design & Development, Inc. (CDDI) having a one-half inch wide, upper metal heat seal bar and a heated silicone rubber pad on the bottom. For samples tested and summarized in the table below, 12 inch wide bags were made with peak strengths of the heat-sealed side seams measured on two inch tensile test strips according to ASTM D 5035-95 (The Standard Test Method for Breaking Force and Elongation of Textile Fabrics—Strip Tensile Method). The tensile strip test samples were prepared with the seam in the center of the sample and perpendicular to the test direction. Samples A through D were made from CLAF® fabrics described below including color and fabric weight expressed in units of grams per square meter ($g/m^2$). The fabric of Sample A was a tangerine color CLAF® fabric having a weight of about 27.1 $g/m^2$ with a multi-layer construction comprising an inner layer of HDPE (melting point=145° C.) and outer layers of an Affinity ethylene-alphaolefin resin melting at about 95–105° C. The fabric of Sample B was a natural color CLAF® fabric having a weight of about 16 $g/m^2$. The fabric of Sample C was a natural color CLAF fabric having a weight of about 18 $g/m^2$ and the fabric of Sample D was a red color CLAF® fabric having a weight of about 22 $g/m^2$. The fabrics of Samples B, C and D had a 145° C. melting point HDPE inner layer and outer layers of LDPE resin melting at 110° C. The side-seams of Samples A–D were heat sealed with the upper seal bar maintained at temperatures of 310° or 320° F., a pressure of 60 psi and dwell times of 0.75 or 1.25 seconds. Indication is also given in the table below as to "Side In" which refers to which side of the fabric, having MD strands and CD strands laminated to each other, was facing inward as the seam was heat-sealed. Peak seam strengths ranged from 1.1 to 3.1 lbs/2 inch.

TABLE I

| | Test Conditions | | | Seam Strength |
|---|---|---|---|---|
| Sample | Temp., ° F. | Side In | Dwell Time, sec | lbs/2 inch |
| A | 310 | CD | 0.75 | 2.0 |
| A | 310 | MD | 0.75 | 2.8 |
| A | 310 | CD | 1.25 | 1.9 |
| A | 310 | MD | 1.25 | 2.8 |
| A | 320 | CD | 0.75 | 1.8 |
| A | 320 | MD | 0.75 | 3.1 |
| B | 310 | CD | 0.75 | 1.9 |

TABLE I-continued

| Sample | Test Conditions Temp., ° F. | Side In | Dwell Time, sec | Seam Strength lbs/2 inch |
|---|---|---|---|---|
| B | 310 | CD | 1.25 | 2.5 |
| B | 320 | CD | 1.25 | 2.3 |
| B | 320 | CD | 0.75 | 2.1 |
| C | 310 | CD | 0.75 | 1.1 |
| C | 310 | CD | 1.25 | 1.1 |
| C | 320 | CD | 1.25 | 1.2 |
| D | 310 | CD | 1.25 | 1.1 |
| D | 310 | MD | 1.25 | 2.4 |
| D | 320 | CD | 0.75 | 1.3 |

EXAMPLES

A series of 10-pound open mesh bags was made using the side-seam construction illustrated in FIG. 1 and FIG. 2. The bag material was a cross-laminated thermoplastic net-like web fabric available from Amoco-Nisseki CLAF, Inc. under the designation of CLAF®. The film strip layer of heat-sealable material was an ethylene alpha-olefin resin available from Dow. In Examples A1 through A4, bags were made from a tangerine color CLAF® fabric having a weight of about 30 g/m$^2$. For Examples B1 through B5, bags were made from a natural color CLAF® fabric having a weight of about 18 g/m$^2$ and for Examples C1 through C4 bags were made from a green color CLAF® fabric having a weight of about 18 g/m$^2$. The heat-sealable film used to form the side seams for Examples A1 through B3 was a one inch wide strip of two mil blown film made from Affinity PF 1140 ethylene alpha-olefin resin from Dow having a melting point of 94° C. according to the manufacturer's literature. For Examples B4 through C4 the heat-sealable film was a one inch wide strip of a 1.25 mil blown film made from a 1:1 blend of Affinity PF 1140 resin and a linear low density polyethylene available from Deerfield Plastics. Melting point of the fabric resins were 145° C. for the central HDPE layer and 110° C. for the outer LDPE layers. The side seams of the bags were made with the strands of CLAF® fabric next to the heat-sealable film in the machine direction and the seams were heat-sealed with the CDDI heat sealer described above with the temperature of the upper, metal seal bar varied and the lower silicone rubber pad temperature maintained at 200° F. using a one half inch wide sealing bar. For the Examples tested and summarized in Table 2 below, 12 inch wide bags were made with heat-sealed side seam strengths tested on two-inch tensile test strips according to ASTM D 5035-95. The tensile test strips were prepared so that the seam was in the center of the sample and perpendicular to the test direction. The entry "2×0.13" in the dwell time column in Table 2 indicates that the side seam was heat sealed once at 60 psi for 0.13 sec, then the bag was turned over and the reverse side of the seam was heat sealed for another 0.13 sec at 60 psi. This process was used to simulate heat sealing on commercial equipment having two heat seal sections in series with the first section having a heat seal bar on top and a silicone pad on the bottom and the second section having the bar and pad positions reversed. The entry "1×0.13" indicates heat sealing with a single exposure for 0.13 second at 60 psi. Examples B1–B5 and Comparative Sample C were made from the same fabric. The strengths of the side seams of Examples B1–B5 with a heat-sealable material used between the fabric layers of the seams were 1.9 to 12.1 lbs/2 inch whereas the seam strengths of Comparative Sample C were 1.1 to 1.2 lbs/2 inch, demonstrating the enhancement of the peak side seam strength with the addition of the heat-sealable film strips.

TABLE 2

| Example | Test Conditions Temp., ° F. | Dwell time, sec | Seam Strength, lbs/2 inch Average | Standard Dev. |
|---|---|---|---|---|
| A1 | 390 | 2 × 0.13 | 12.9 | 1.8 |
| A2 | 400 | 2 × 0.13 | 11.9 | 2.1 |
| A3 | 410 | 2 × 0.13 | 12.8 | 1.5 |
| A4 | 420 | 2 × 0.13 | 12.8 | 1.6 |
| B1 | 350 | 2 × 0.13 | 12.1 | 0.9 |
| B2 | 340 | 2 × 0.13 | 7.8 | 2.8 |
| B3 | 340 | 1 × 0.13 | 7.3 | 3.8 |
| B4 | 340 | 2 × 0.13 | 1.9 | 0.8 |
| B5 | 340 | 2 × 0.23 | 3.1 | 1.2 |
| C1 | 400 | 2 × 0.13 | 4.9 | 4.0 |
| C2 | 350 | 2 × 0.13 | 2.1 | 2.2 |
| C3 | 375 | 2 × 0.13 | 7.1 | 3.3 |
| C4 | 340 | 2 × 0.13 | 3.2 | 3.2 |

The bags of Examples A1 through A4 were then subjected to a series of so-called drop tests. In these tests, each bag was filled with 20 baseballs weighing about 180 to 190 grams apiece for a total weight per bag of about 8.3 pounds. The bags were then dropped on their butt ends from a height of 3.5 feet onto a concrete surface. The tabulated results are the number of drops a bag passed before failure of a side seam. Of eleven bags of Example A2 tested, two bags were dropped ten or more times before failure of a side seam occurred. These bags with side seams heat sealed with heat-sealable film strips between the layers of open mesh fabric all passed three drops or more before side seam failure. Thirteen other bags of Examples A1, A3 and A4 were drop tested and the results are also summarized below. Only one bag out of 24 tested from Examples A1–A4 failed on the initial drop.

TABLE 3

| Drops | Example A2 bags | Example A1, A3 and A4 bags |
|---|---|---|
| 10 | 2 | 1 |
| 9 | 2 | 1 |
| 8 | — | 1 |
| 7 | — | 1 |
| 6 | 1 | 1 |
| 5 | 3 | 1 |
| 4 | 2 | 2 |
| 3 | 1 | 1 |
| 2 | — | 2 |
| 1 | — | 1 |
| 0 | — | 1 |

In a second battery of drop tests, bags of Example A2 were subjected to a drop test with 10 lbs of potatoes. The drop tests were butt drops from 3.5 feet onto a concrete surface. Of nine bags tested, all bags passed four or more drops. Specific results were four bags at four drops, three bags at five drops, one bag at six drops and one bag at seven drops.

In another Example (D), a commercially available bag of leno weave polypropylene fabric (melting point about 160° C.) and sewn seams was obtained and the seams cut off and resealed with 2 mil blown film made from Affinity PF 1140 resin as the heat-sealable material between the fabric layers. The CDDI heat sealer was used with top bar temperature of 360° F. and silicone pad temperature of 200° F., pressure of 60 psi and two 0.15 second dwell times. Seam strength, tested per ASTM D 5035-95, yielded average strength of 1.70 lbs/2 inch. This example demonstrates the invented bags made from woven fabric, but seam strength was lower than in preceding examples. A wider seam or use of a sealing strip of a resin with a seal initiation temperature closer to the melting point of polypropylene, or with better adhesion to polypropylene, would have provided higher seam strength.

We claim:

1. A bag comprising an open mesh fabric and having a closed, butt end, an opposing end, an interior, an exterior, at least a first longitudinal edge, at least a second longitudinal edge and at least two longitudinal seams extending from the butt end to the opposing end, wherein the butt end is formed by a fold in the fabric on a central axis and each seam comprises a section of fabric from each side of the fold to which is heat sealed a thermoplastic sealing strip thereby forming at least two longitudinal flat seams, and wherein said at least a first longitudinal edge and at least a second longitudinal edge extend to said exterior of said bag.

2. The bag of claim 1 wherein the opposing end is open.

3. The bag of claim 1 wherein the opposing end is closed.

4. The bag of claim 1 wherein formation of said bag via flat seams and heat sealed thermoplastic sealing strip allow said bag to be formed via high speed automated bag-making machinery.

5. The bag of claim 4 wherein the fabric comprises a nonwoven fabric.

6. The bag of claim 5 wherein the nonwoven fabric comprises a cross-laminated netlike web.

7. The bag of claim 4 wherein the fabric comprises a woven fabric.

8. The bag of claim 4 wherein the fabric comprises a knitted fabric.

9. The bag of claim 4 wherein the fabric comprises an extruded net or scrim.

10. The bag of claim 4 wherein a label in the form of a printed or printable thermoplastic band is affixed to the fabric.

11. The bag of claim 1 wherein the longitudinal seams have a strength of at least about 5.0 lbs/2 inch as measured by ASTM D 5035-95.

12. The bag of claim 1 wherein the open mesh fabric has a coefficient of friction according to ASTM 3334-80 Section 15 of less than about 30° and dimensional stability such that the fabric, when folded and seamed, can withstand a force of at least about one g without substantial deregistration.

* * * * *